United States Patent [19]

Paulokat

[11] 4,367,637

[45] Jan. 11, 1983

[54] APPARATUS FOR THE MAINTENANCE OF REFRIGERATION EQUIPMENT

[75] Inventor: Horst Paulokat, Horneburg, Fed. Rep. of Germany

[73] Assignee: Messerschmitt-Boelkow-Blohm GmbH, Munich, Fed. Rep. of Germany

[21] Appl. No.: 274,870

[22] Filed: Jun. 18, 1981

[30] Foreign Application Priority Data

Jun. 27, 1980 [DE] Fed. Rep. of Germany ..... 3024098

[51] Int. Cl.[3] ..... F25B 45/00

[52] U.S. Cl. ..... 62/292; 62/77

[58] Field of Search ..... 62/77, 149, 292; 165/95

[56] References Cited

U.S. PATENT DOCUMENTS

| | | | |
|---|---|---|---|
| 2,746,258 | 5/1956 | Hagans | 62/292 X |
| 3,299,524 | 1/1967 | Jacobs | 62/77 X |
| 3,443,392 | 5/1969 | Alexander | 62/77 |
| 4,083,399 | 4/1978 | Babish et al. | 165/95 |
| 4,285,206 | 8/1981 | Koser | 62/292 X |

*Primary Examiner*—William E. Wayner

*Attorney, Agent, or Firm*—W. G. Fasse; D. H. Kane, Jr.

[57] ABSTRACT

The maintenance of refrigeration equipment, for example on board airborne refrigeration equipment, is greatly facilitated by a portable maintenance apparatus. For this purpose the portable apparatus comprises a first section for pressure emptying any refrigeration circulatory conduits by using pressurized nitrogen. A second section including at least one hand operated pump is used for refilling the refrigeration circulatory conduits with refrigerant. Both sections are provided with quick-release couplings for a rapid connection to and disconnection from a refrigeration system. The apparatus also includes a venting device for venting the refrigeration system including any intermediate circulatory conduits.

9 Claims, 9 Drawing Figures

APPARATUS FOR THE MAINTENANCE OF REFRIGERATION EQUIPMENT

CROSS-REFERENCE TO RELATED APPLICATIONS

The present application is based on the corresponding German patent application No. P 3,024,098.3 filed in the Federal Republic of Germany on June 27, 1980. The priority of the German filing date is claimed for the present application.

BACKGROUND OF THE INVENTION

The invention relates to an apparatus for the maintenance of refrigeration equipment, specifically refrigeration equipment including an intermediate circuit.

Refrigeration equipment operating in accordance with the Rankine cyclical process generally comprise a closed circuit for the refrigerant such as may be based on fluorine and hydrocarbons. If the equipment components participating in the cyclical process such as the heat absorber or froster and the equipment for discharging heat such as the compressor and cooling coils are separated from one another in space, it is necessary to convey the refrigerant through respective pipe conduits. Refrigeration equipment on board of aircraft, comprise in addition to the above mentioned first or primary circuit, a second circuit also referred to as an intermediate or secondary circuit located between the cooling component of the system and the remaining refrigeration components of the system. A second refrigerant circulates within this secondary circuit. The second refrigerant may for example consist of a propylene-glycol water mixture. In this type of refrigeration system only the second refrigerant, which does not cause any problems as compared to the refrigerant in the primary system, is caused to circulate through the pipe conduits installed on board between the refrigerating means proper and the remaining components of the system in the kitchen zone.

Due to the just described arrangement of the on-board systems, the following steps are necessary for the maintenance of such systems. First the pipe conduits of the secondary circuit are to be emptied under pressure with the aid of pressurized nitrogen. Second, the pipe conduits must be replenished or refilled with refrigerant. Third, the system must be vented. Due to the described structural arrangement these steps are limited to the secondary circuit.

It is known, that these steps are performed with due regard to prescribed maintenance procedures. However, the performance of these steps is rather uneconomical. For example, the emptying under pressure involves the use of a separate apparatus provided specifically for this purpose. The replenishing or refilling and venting is performed by means of a multi-purpose apparatus which is constructed to also permit maintenance work on the primary circuit. Accordingly, this multi-purpose apparatus is rather expensive in its structure and accordingly it is not suitable for being taken on board for the performance of maintenance work. Besides, this type of apparatus requires two operators. One operator is stationed on board and connects or disconnects the respective couplings at the corresponding interface on board. The other operator handles the multi-purpose apparatus on the ground. Thus, the two operators necessarily require a communication link between each other for example in the form of a ratio link, such as a walkie-talkie. Besides, this multi-purpose apparatus depends on an external power supply because its installed pump is electrically driven.

OBJECTS OF THE INVENTION

In view of the above it is the aim of the invention to achieve the following objects singly or in combination:

- to provide a light weight, simple maintenance apparatus for the above purposes, which is independent of an external power supply and hence portable;
- to provide a refrigeration maintenance apparatus with the aid of which it is possible to empty under pressure and refill as well as vent refrigeration circuits, especially secondary refrigeration circuits of cooling systems in a simple manner;
- to simplify the sequence of maintenance steps so that they may possibly be performed by a single operator without the need for a radio link; and
- to arrange all the necessary controls and gages on a common control panel which is preferably installed in a portable housing.

SUMMARY OF THE INVENTION

According to the invention there is provided an apparatus for the maintenance of a refrigeration system especially one comprising secondary circuits between the refrigerating means proper and the cooling devices which is characterized by a first section including means for the pressure emptying of the pipe conduits of the refrigeration system including any intermediate or secondary refrigerant circulatory conduits or circuits whereby the emptying is accomplished by means of nitrogen under pressure and a second section for refilling or replenishing these circuits with a refrigerant, as well as venting means of the refrigeration equipment, especially the intermediate or secondary circuit.

This type of apparatus can be carried on board, for example of an aircraft, where it is connected directly to the coupling points at the interface between the refrigeration means proper and the intermediate or secondary circulatory conduits. A single operator can perform this work and an external power source has been obviated by the use of one or two hand operated pumps.

BRIEF FIGURE DESCRIPTION

In order that the invention may be clearly understood it will now be described, by way of example, with reference to the accompanying drawings, wherein.

Figure 3A:
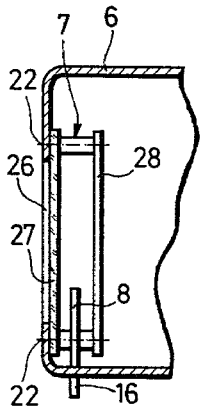
Figure 3B:
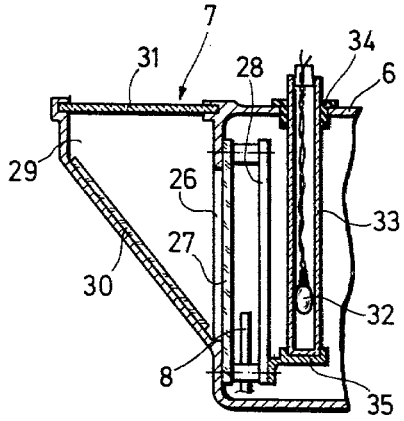
Figure 3C:
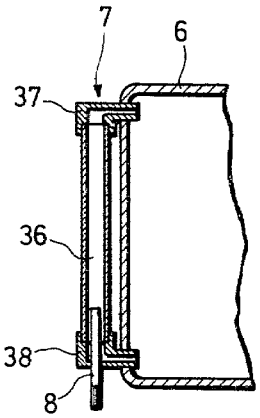
Figure 4A:
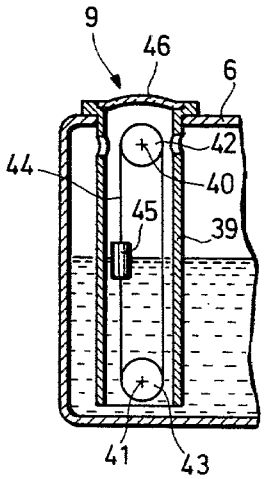
Figure 4B:
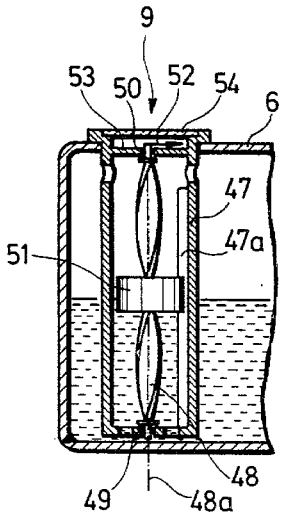
Figure 5:
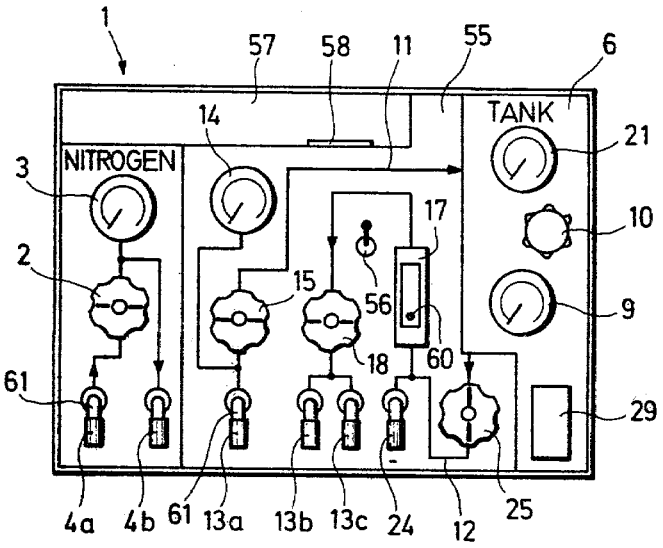
Figure 6:
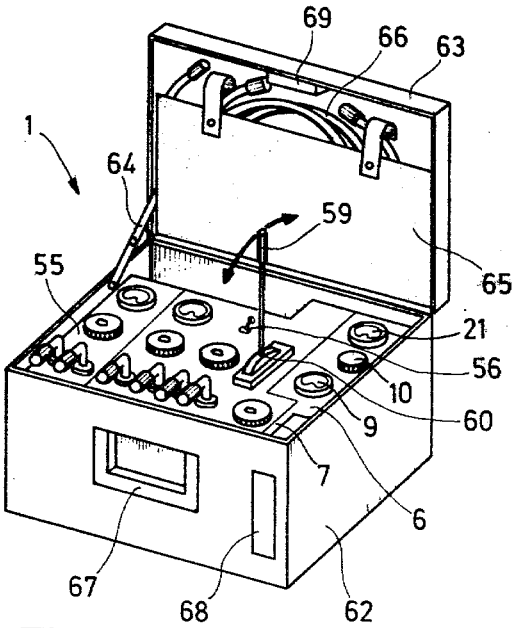

FIGS. 3*a*, 3*b*, and 3*c* illustrate three different modifications of a sight glass suitable for the present apparatus;

FIGS. 4*a*, and 4*b* illustrate two different embodiments of a liquid level indicator suitable for the present apparatus;

FIG. 5 shows a top plan view of a control panel of the present apparatus; and FIG. 6 shows a perspective view of the present apparatus embodied in a portable housing.

DETAILED DESCRIPTION OF PREFERRED EXAMPLE EMBODIMENTS AND OF THE BEST MODE OF THE INVENTION

Figure 1:
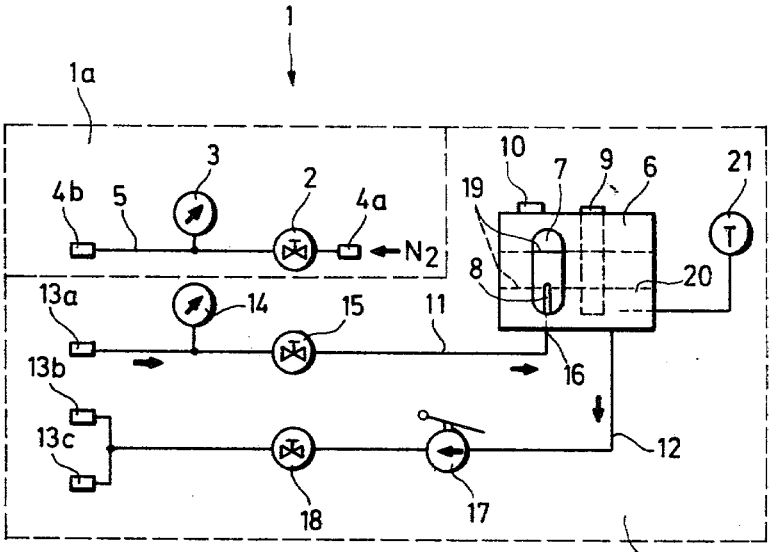
FIG. 1 shows a circuit diagram of the apparatus according to the invention.

FIG. 1 shows the circuit diagram of an apparatus 1 according to the invention for the pressure emptying, refilling or replenishing and venting of a secondary circuit of refrigeration systems and of the refrigeration systems themselves. The apparatus comprises a nitrogen section 1*a* and a refrigerant section 1*b* each forming flow conduit means. The nitrogen section or conduit means 1*a* comprises substantially a closure valve 2, a pressure meter or gage 3 and two coupling members 4*a* and 4*b* interconnected by a conduit 5 such as a hose or a pipe. The refrigerant section or conduit means 1*b* comprises substantially a tank 6 equipped with a sight or gage glass 7 including an inlet pipe 8 visible through the sight glass 7. The refrigerant section 1*b* further comprises a liquid level indicator 9 and a filler inlet port 10 provided with a venting channel. An inlet duct or conduit 12 is also connected to the tank 6. The inlet conduit 11 is connected at 16 to the inlet pipe 8. A coupling member 13*a* is connected to the opposite free end of the inlet conduit 11. A valve 15 is connected into the inlet conduit 11 and a pressure gage 14 is connected to the inlet conduit 11.

The outlet conduit 12 is connected to the tank at one end and to coupling members 13*b* and 13*c* at the other end. A hand operated pump 17 and a valve 18 are connected in series into the discharge conduit 12. The hand operated pump 17 has a capacity of providing at least a pressure of 65 psi. The tank 6 holds refrigerant 20 the maximum and minimum levels are indicated by dashed lines 19. A temperature gage 21 is also connected to the tank 6 for measuring the temperature of the refrigerant 20.

Initially, the apparatus is prepared for operation by closing all valves 3, 15, and 18. The coupling member 4*a* of the pressure emptying conduit 5 is connected to a nitrogen source under pressure such as a conventional pressurized bottle. The tank 6 is filled with the refrigerant 20 to an extent shown by the upper dashed line 19 on the sight glass 7 indicating the maximum filling level or quantity. This quantity is measured so that it is sufficient for the refilling of conventional cooling systems. The temperature of the refrigerant 20 is monitored or checked by means of the thermometer 21.

The coupling members 4*a*, 4*b*, and 13*a*, 13*b*, as well as 13*c* are of the rapid make and break type for interconnecting the conduits 5, 11, and 12 with conduits of the refrigeration system on which the maintenance work is to be performed. The refrigeration system as such is now shown. These rapid make and break coupling members assure a rapid release and reconnection of the filled conduits substantially without any liquid escape. Additional hose sections also equipped with rapid make and break coupling members are provided for the apparatus as shown at 66 in FIG. 6. In describing the operational steps to be performed with the aid of the present apparatus it is assumed that the intermediate or secondary circulatory conduits have been completely installed on board, however, that they have not yet been filled with refrigerant.

For pressure emptying the on-board pipe conduits, which extend between the refrigerating means proper and the cooling devices, it is suitable to place the apparatus 1 near the refrigeration means proper. The connections of the pipe conduits between the refrigeration means proper and the cooling devices are released. Thereafter, the pipe connections of the cooling devices are shortcircuited by means of a bridging hose which is provided with the required number of branch lines, whereby all the pipe conduits of the cooling devices are interconnected. The pipe connection of the refrigerating means leading to the cooling devices is connected to the coupling member 4*b* of the apparatus 1. Thereafter, the valve 2 is slowly opened, until the pressure gage 3 indicates the desired testing pressure of, for example, 100 psi. This pressure is derived, as mentioned, from a conventional pressurized nitrogen bottle indicated symbolically at $N_2$. The valve 2 is closed again when this testing pressure is reached. The so adjusted pressure now prevails within the entire pipe or conduit system. The system does not have any leaks if the testing pressure remains constant for a time of about 15 minutes. Upon completion of this pressure test, the coupling member 4*a* is disconnected from the nitrogen source $N_2$, the valve 2 is opened and the connecting hose is disconnected from the coupling member 4*b*.

In order to fill the cooling devices with refrigerant 20, the bridging hose is removed and the pipe conduits are reconnected to the cooling devices. Thereafter, the coupling members 13*a* and 13*b* of the refrigerant section 1*b* are connected to one of the cooling devices in such a manner that the coupling member 13*b* is connected to the inlet port, while the coupling member 13*a* is connected with the outlet port of the cooling device. Thereafter, the valves 15 and 18 are opened and the refrigerant 20 is conveyed by means of the hand pump 17 from the tank 6 into the cooling device. Thus, any gas present in the conduit system flows out through the conduit 11 so that gas bubbles rise through the inlet pipe member 8 and become visible through the sight glass 7. When no further bubbles emerge from the inlet pipe member 8 the conduit system is filled with refrigerant and properly vented.

Cooling devices having a branching circulatory system comprise, for example, two inlet connectors and a common back-flow connector. In such an instance, both branches are filled simultaneously through the coupling members 13*b* and 13*c*. Such a system is completely vented only if during the pumping of the refrigerant 20 both inlet connectors or ports of the system have been repeatedly and alternately been connected and if the back-flow from the cooling device is free of bubbles in the sight glass 7. In this type of operation, the coupling member 13*b* or 13*c* which is not used, is disconnected.

A certain quiescent state pressure which depends on the temperature of the refrigerant 20 is required for a reliable operation of the cooling device. This quiescent state pressure within the system will vary with the type of refrigerant. In order to establish this pressure, which is available from conventional tables, the valve 15 is closed and the hand pump 17 is operated until the pressure gage 14 indicates the desired pressure. Thereafter, the valve 18 is also closed and the connections to the system are released. Since the refrigerating means proper are normally filled with refrigerant in the factory and thus have the correct quiescent pressure, the cooling system becomes operational after the conduit system has been connected to the refrigerating means proper.

Further steps that may be performed with the apparatus 1 shall now be briefly mentioned. If the system to be tested is already filled with refrigerant, the latter may be removed by blowing nitrogen into the system, whereby the return conduit is connected to a suitable receptacle, not shown. Further, it is possible to use the present apparatus for scavenging a cooling system. For this purpose the tank 6 is filled with a scavenging liquid for example, distilled water, rather than with refrigerant. The scavenging liquid is then conveyed through the system with the aid of the hand pump 17, whereby the return conduit again is connected to a suitable receptacle. Basically, the apparatus 1 can also be used to perform all the above mentioned maintenance or checking steps on the refrigerating means proper of a cooling system. If in this connection it is necessary to pump a liquid into the refrigerating means proper, the required opening pressure of the valves forming part of the refrigerating means proper is established by operating the hand pump 17 of the apparatus 1.

Figure 2:
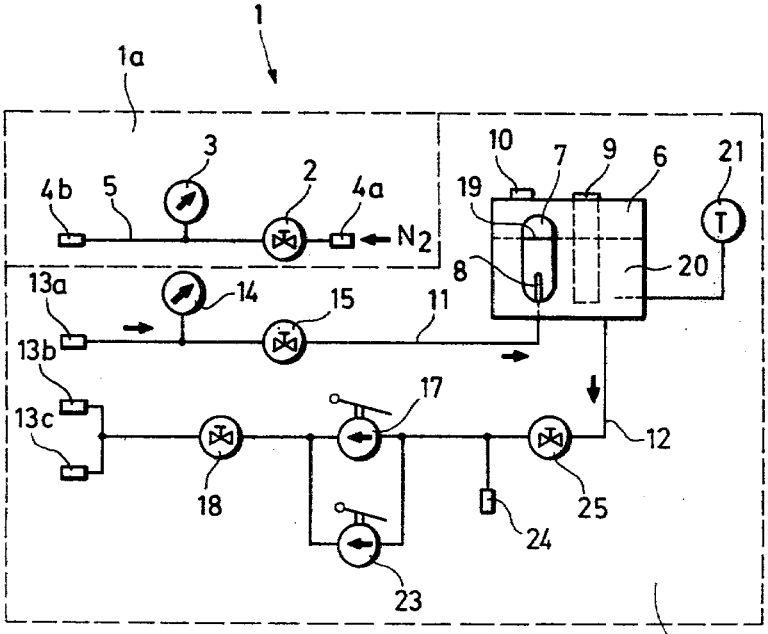
FIG. 2 illustrates a modification of the circuit according to FIG. 1, whereby the modification comprises a double pump and an inlet port for a scavenging liquid.

FIG. 2 shows a modification of the basic circuit arrangement according to FIG. 1, whereby in addition to the pump 17 a further hand pump 23 is connected in parallel to the pump 17. The pump 23 has a noticeably larger stroke volume as compared to the pump 17. Thus, when operating the pump 23 the time necessary for the filling operation is substantially reduced. In this embodiment it is the purpose of the pump 17 to maintain or establish the pressure if the system itself is already filled. The same purpose could be achieved, by replacing the pumps 17 and 23 by a single pump which is switchable as far as its conveying volume and pressure are concerned. The circuit arrangement of FIG. 2 further comprises a coupling member 24 and a valve 25 which is always open when the tank 6 is used. This type of arrangement makes it possible to pump refrigerant out of an auxiliary container not shown, to which the coupling member 24 may be connected. In that instance the valve 25 is closed.

FIG. 3*a* shows a section through the tank 6 which is provided with an opening 26 covered in a fluid type manner by a see-through pane 27. A preferably wide background screen 28 is positioned behind the pane 27 and spaced therefrom by fastening means 22 including for example, screws and spacer members, as is conventional. The fastening means 22 also secure the pane to the wall of the tank 6, whereby a sealing, not shown, provides the above mentioned liquid-tight seal between the pane and the wall of the tank. An inlet pipe member 8 extends through the wall of the tank into the spacing between the pane 27 and the background screen 28. The outer end 16 of the inlet pipe member 8 is connected to the inlet conduit 11. Thus, the sight glass 7 permits the reading of the liquid level 19 in the tank 6 and also the viewing of any fluid flowing through the inlet conduit 11 and through the pipe elements 16 and 8 into the tank 6. Any bubbles in the incoming fluid can be seen through the window pane 27.

FIG. 3*b* shows another modification of a sight glass 7'. In this embodiment the liquid level and fluid coming in through the end pipe member 8 may be viewed vertically downwardly through the window 27 against the background screen 28, which is translucent for light emanating from a light bulb 32 in a transparent tubular member 33 extending into the tank 6 through a sealing bushing 34 and held in position by a bracket 35. A mirror 30 is held in a slanted position in a light shaft 29. The horizontal top opening of which is covered by a transparent pane 31. Due to the slanted position of the mirror 30 it is possible to inspect anything that occurs in the space between the pane 27 and the background screen 28. The possibility of observing in a vertically downward direction may be convenient for certain installations. The transparent window pane 31 prevents the entry of dust and other extraneous matter which might otherwise settle on the mirror 29, thereby impairing the visibility. As mentioned, the background screen 28 is transparent or translucent. Additionally, the screen 28 is capable of scattering the light that impinges on the back side of the screen 28, as it emanates from the light bulb 32.

FIG. 3*c* shows a further sight glass 7'' which comprises a transparent tubular member 36, connected to communicate with the tank 6 through elbow connectors 37 and 38. The inlet pipe member 8 extends through the lower elbow connector 38.

In each of these three embodiments the respective sight glass will be provided with the markings 19 for indicating the maximum and minimum tank filling level as shown in FIG. 1. Further, the sight glass may be provided with a volume scale, such as a liter scale.

FIG. 4*a* shows a liquid level or rather liquid volume indicator 9 installed in the tank 6. The indicator 9 comprises a housing 39 extending into the tank and covered by a see-through cover 46. Two pulleys 42 and 43 are arranged vertically one above the other on axles 40 and 41 securely held in the housing 39. An endless tape or belt 44 runs around these pulleys 42, 43. A float 45 is rigidly secured to the tape or belt 44. The tape 44 and the pulleys 42, 43 are constructed so as to minimize friction therebetween. The float 45 is secured to a defined position along the tape relative to a volume scale, such as a liter scale on the tape 44. Thus, depending on the position of the float, which indicates the liquid level in the tank, it is possible to read the volume of the liquid in the tank through the window 46.

FIG. 4*b* shows another embodiment of a volume indicator 9' comprising a housing 47 in which a screw type member 48 is rotatably held in two bearings 49 and 50. A float 51 surrounds the screw type member 48 like a threaded nut but cannot rotate because it engages a guide member 47*a* extending vertically alongside the housing wall of the housing 47. The vertical position of the float 51 is determined by the liquid level in the tank. Due to the given pitch of the threading 48, each position of the float 51 corresponds to a predetermined rotation of the screw around its vertical axis 48*a*. Thus, a pointer 52 secured to the rotational axis of the screw 48 provides an indication of the volume within the tank and such indication may be read on a scale 53 through a window 54.

FIG. 5 illustrates an example embodiment of a control and operation panel 55 of the apparatus 1. The control and operational panel 55 supports the following elements. A handle for the valve 2, the nitrogen pressure gage 3, the nitrogen coupling members 4*a* and 4*b*, the thermometer 21, the inlet filling port 10, the liquid volume or liquid level indicator 9, the light shaft 29 for the sight glass 7' and the following elements for handling a liquid, particularly the refrigerant 20. For this purpose, there is provided the hand pump 17, the valves 15, 18, and 25 as well as the pressure gage 14 and the coupling members 13*a*, 13*b*, 13*c*, and 24. The panel 55 further comprises a light switch 56 for switching on and off the light bulb 32, which may be operated by a battery held in a space below the panel 55 and accessible through cut-out 57, which may hold tools and the like. A cover 58 may close the battery holding space and is accessible from the cut-out 57 in the panel.

Preferably, the above mentioned valves are provided in the form of so-called tap valves or cocks, whereby a more rapid operation may be accomplished. Besides, such an embodiment which uses valves with handles visible on top of the panel 55 makes it possible to locate the valve handles in a functional diagram shown on the face of the panel 55. Each handle would be provided with a flow-through direction indicator so that the operational position of each valve is directly visible in the diagram.

As mentioned above, the light shaft 29 or rather the sight glass means 7' are equipped with a light bulb 32 in accordance with FIG. 3*b* which is supplied by a battery and switched on and off through the switch 56. The thermometer 21 may be constructed as a tubular thermometer in which case the thermometer could be arranged inside the tank, so that it is visible through the sight glass means 7'.

The hand pump 17 may be operated by a hand lever 59 shown in FIG. 6, which may be inserted into a socket 60 shown both in FIGS. 5 and 6. The above mentioned coupling members are secured to the control panel 55 by means of conventional elbows 61. Thus, it is possible to connect any hose conduits to the front side of the apparatus 1 which also facilitates the release of the coupling members from the hose conduits. For simplicity's sake the respective handles for the valve have been provided with the same reference numbers as the valves themselves in describing the arrangement of the control panel 55.

FIG. 6 shows a perspective overview of the apparatus 1 comprising a housing 62 forming a carrying case having a cover 63 secured to the housing 62 by hinges not shown. An arresting mechanism 64 of conventional construction holds the cover 63 in an upright position as shown. Inside the cover, a space 65 is provided for holding connector hoses 66. The control and operation panel 55 with the above described operating and indicating components is installed in the carrying case 62, whereby the pump operating lever 59 is inserted into the socket 60. When the lever 59 is removed the cover may be closed. The lever 59 may, for example, be stored in the cut-out or space 57 shown in FIG. 5. The housing or carrying case 62 comprises a carrying handle 67. In shown embodiment the light shaft 29 has been replaced by a window 68 which may be covered by a flap and through which, for example, the sight glass 7 of FIG. 3*a* or the sight glass 7'' of FIG. 3*c* is visible. When the flap closing the window 68 is opened, the sight glass of the tank 6 becomes visible. A glare-free lamp 69 is installed in the cover 63. The lamp 69 may also be operated by switch 56. If desired, the cover 63 may be removable. In this instance, the hinge and the arresting means 64 are respectively constructed and the lamp would be connected to the battery in the housing through a respective plug-in connection. The cover 63 may be locked to housing 62 by conventional means.

If the operating and control panel 55 comprises several partial panel members, for example, to facilitate its manufacture, all panel members would form together the operation surface of the apparatus 1. Thus, the entire operation surface of the apparatus comprises the sum of all surface elements which are provided with indicating or operating elements. In this sense, the window 68 is considered to be part of the overall control panel.

Although the invention has been described with reference to specific example embodiments, it will be appreciated, that it is intended, to cover all modifications and equivalents in the scope of the appended claims.

What is claimed is:

1. An apparatus for the maintenance of refrigeration equipment, comprising first conduit means (1*a*) including first coupling members connectable to said refrigeration equipment and to a source of nitrogen under pressure for pressure emptying said refrigeration equipment, second conduit means (1*b*) including second coupling members and a source of refrigerant connectable to refrigeration equipment and to said source of refrigerant for replenishing refrigeration equipment with new refrigerant, and venting means forming part of said second means connectable to refrigeration equipment for venting the refrigeration equipment, and wherein said second conduit means (1*b*) comprise a tank for holding a quantity of refrigerant, an inlet conduit (11) operatively connected to said tank (6), an outlet conduit (12) operatively connected to said tank (6), a pressure gage (14) operatively connected to said inlet conduit, a valve (15) operatively connected in said inlet conduit (11), further valve means (18) connected in said outlet conduit (12), and pump means (17) operatively connected to said outlet conduit (12) for conveying refrigerant, said second coupling means being connected to the free end of said outlet conduit means (12).

2. The apparatus of claim 1, wherein said first conduit means comprise a first conduit (5) wherein said first coupling members are connected to the ends of said first conduit, a closure valve (2) operatively connected in said first conduit (5), and a pressure gage (3) operatively connected to said first conduit (5) whereby said first conduit is connectable to a source of nitrogen under pressure at one end thereof and to refrigeration equipment at the other end thereof.

3. The apparatus of claim 1, further comprising sight glass means (7) operatively connected to said tank for visually inspecting the sight glass means, said inlet conduit means having an inlet pipe member (8) positioned for visual inspection through said sight glass means, liquid level indicator means (9) connected to said tank, filling port means (10) connected to said tank, and a temperature gage operatively connected to said tank for measuring the temperature inside said tank.

4. The apparatus of claim 3, wherein said sight glass means comprise a see-through window pane in a wall of said tank, a slanted mirror operatively positioned in front of said window pane and light source means operatively located behind said sight glass means whereby a visual inspection may be made by looking downwardly.

5. The apparatus of claim 3, wherein the liquid level indicator means comprise an endless belt (44), guide rollers (42, 43) operatively arranged and spaced in said tank so that said endless belt runs around said guide rollers, a float attached to said belt in fluid communication with any fluid in said tank for sensing the fluid level in the tank, a scale marked on said endless belt, and window means in said tank so positioned that said scale on the endless belt is visible through said window means.

6. The apparatus of claim 3, wherein said liquid level indicator means comprise float means (51), threaded means movably passing through said float means, guide means (47) arranged for permitting an up and down movement of said float means but preventing rotation of said float means and pointer means operatively connected to said threaded means for indicating the instantaneous position of said float means.

7. The apparatus of claim 1, wherein said further valve means comprise two valves (18, 25) operatively connected in said outlet conduit (12), said second coupling means comprising a further coupling member (24) connected in series with said hand pump means (17) between said two valves (18, 25), said further coupling member (24) being connected to the suction side of said hand pump means, said apparatus further comprising second hand pump means connected in parallel to the first mentioned hand pump means, said second hand pump means having a larger capacity than the first hand pump means, and wherein said second coupling means comprise two coupling members (**13*b*, 13*c*) connected in parallel to the free end of said outlet conduit (12**).

8. The apparatus of claim 1, further comprising sight glass means in the form of a see-through tubular member (36), fluid passage providing connector means (37, 38) operatively securing both ends of said tubular member to said tank, said inlet conduit means (11) having an inlet pipe member (8) reaching into said tubular member (36) of said sight glass means whereby the free end of said inlet pipe member is inspectable in said tubular member.

9. The apparatus of claim 1, further comprising housing means including closeable cover means, said first means, said second means and venting means being operatively positioned in said housing means, control panel means in said housing means, said first and second coupling members being operatively connected to said control panel means, and control means on said control panel means for said first and second means and for said venting means.

* * * * *